United States Patent [19]

Matsuyama

[11] 4,042,206

[45] Aug. 16, 1977

[54] MONOBLOCK HOT TOPS WITH ALIGNED FIBROUS MATERIAL

[75] Inventor: Shigeru Matsuyama, Utsunomiya, Japan

[73] Assignee: Aikoh Co., Ltd., Tokyo, Japan

[21] Appl. No.: 560,903

[22] Filed: Mar. 21, 1975

Related U.S. Application Data

[63] Continuation of Ser. No. 348,338, April 5, 1973, abandoned.

[30] Foreign Application Priority Data

Apr. 10, 1972 Japan ..... 47-35237

[51] Int. Cl.[2] ..... B22D 7/10

[52] U.S. Cl. ..... 249/197; 106/38.2

[58] Field of Search ..... 249/197, 201, 106, 202; 164/7

[56] References Cited

U.S. PATENT DOCUMENTS

| | | | |
|---|---|---|---|
| 1,825,446 | 9/1931 | Dumas | 249/197 |
| 2,156,980 | 5/1939 | Groninger | 249/201 |
| 2,231,813 | 2/1941 | McDonald | 249/201 |
| 3,106,756 | 10/1963 | DeMaison | 249/201 X |
| 3,321,171 | 5/1967 | Gorka et al. | 249/201 |
| 3,373,047 | 3/1968 | Sheets et al. | 249/197 X |
| 3,456,914 | 7/1969 | Konrad et al. | 249/201 |
| 3,512,572 | 5/1970 | Ednell | 164/7 X |

FOREIGN PATENT DOCUMENTS

| | | | |
|---|---|---|---|
| 708,524 | 4/1965 | Canada | 249/201 |
| 75,550 | 5/1961 | France | 249/197 |

*Primary Examiner*—Robert D. Baldwin
*Attorney, Agent, or Firm*—Fay & Sharpe

[57] ABSTRACT

A heat-insulating and retaining molding for hot tops of a hollow monoblock type for placing on the upper end of a ingot mold at the time of making steel ingots, characterized by the construction of a hollow monoblock molding having homogeneous composition, comprising an organic fibrous material, an inorganic fibrous material, a refractory material and an organic binding material, said molding having in its longitudinal section, an inner structure laminated in the longitudinal direction extending along its inner and outer surface and constituting the thickness of the molding, or the inner side portion of said molding having an inner structure laminated in the longitudinal direction along the inner surface of the molding.

4 Claims, 3 Drawing Figures

MONOBLOCK HOT TOPS WITH ALIGNED FIBROUS MATERIAL

This Application is a Continuation of Application Ser. No. 348,338, filed Apr. 5, 1973, now abandoned.

The present invention relates to an improvement in or relating to a heat-insulating and retaining molding for hot tops of a hollow monoblock type for placing on the top of an ingot mold at the time of making steel ingot.

It has been known heretofore that, by placing a heat-insulating and retaining molding for hot tops on the top of an ingot mold for making an ingot of iron or steel, or by disposing it on the upper end of the inner wall of an ingot mold, sound steel ingots are obtained due to the prevention of the formation of shrinkage pipes, the saving of molten steel is achieved and the blooming yield can be improved.

Up to date, attention has not been especially paid to such problems as the internal structure of the above-mentioned molding, and a molding that is assembled with divided pieces, disposed on the upper end of the internal wall of the mold and consisting of a substantially plate-like molding piece and a wedge-like piece, needs not to have a strength resistant to the bath pressure from the interior, since it is supported by the internal wall of the ingot mold. And in case it is a molding of a plate-like form, an internal structure in the form of a lamination extending along the surface is necessarily produced in the molding process and the molding has also the strength. However, in case of a heat-insulating and retaining molding for hot tops of a monoblock type for placing on the top of an ingot mold, it is desirable to resist, in particular, the static pressure and thermal stresses which the molten steel produces from the inside, and by making the mold to have the strength resistant to the static pressure of the molten steel, it is possible to realize the minimum thickness of the molding that will not decrease the effect of retaining the heat of hot top.

However, in case of a hollow heat-insulating molding which is placed on the top of an ingot mold, the structure of the interior 2 which constitutes the thickness of the molding 1 such as shown in FIG. 1, generally has, in its longitudinal section, the form of a lamination extending in substantially horizontal direction throughout its inside 3 and outside 4 interior, and cannot resist the bath pressure and the thermal stress produced from inside of the molding in use and produces cracks in certain cases, and may cause accidents such as run-out. Accordingly, even if the strength of the molding is strengthened by increasing the wall thickness of the molding, the above-mentioned disadvantages cannot yet be improved.

According to a characteristic method for producing such molding, it is possible to change the internal structure of the hollow monoblock type molding into a structure having the form of a lamination extending in substantially horizontal direction along the inside or outside surface of the molding, and the above-mentioned disadvantages are thoroughly eliminated.

In this regard, the present invention has for object to provide a hollow, monoblock molding having a composition, consisting of an organic fibrous material, an inorganic fibrous material, a refractory material and an organic binding material, said molding having, in its longitudinal section, an internal structure laminated in the longitudinal direction along its inside and outside surface constituting the thickness of the molding, or having an internal structure of the inner side, laminated in the longitudinal direction along the inner surface of the molding.

By changing the molding into a hollow, heat-insulating and retaining molding for hot tops having an internal structure such as mentioned above, it is improved to have a strength resistant to the bath pressure and thermal stresses occurring from the inside, and the disadvantages of such incapability of casting as caused by the run-out occurring from the cracks which have been produced in the molding as arise in the conventional process, can be eliminated. The thickness of the molding itself can consequently be made to have a thickness substantially the same with that of a thin molding which is disposed on the inner wall of ingot mold, minimum thickness necessary for retaining the heat of the hot top, and an effect of saving materials for said molding can be expected.

The present invention will now be described with reference to the accompanying drawings, in which FIG. 1 is a longitudinal section of the top of an ingot mold on which a heat-insulating and retaining molding for hot tops, having undesirable internal structure is placed;

In the following detailed description of the individual Figures shown in the drawings like parts are identified by like numerals, except those parts associated with FIG. 2 are marked with a prime (') and those for FIG. 3 with a double prime (").

Figure 1:
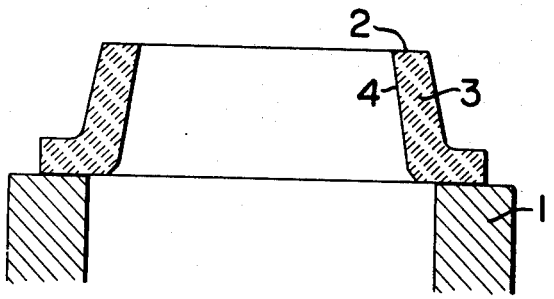
FIG. 1 PRIOR ART

FIG. 1 is a longitudinal section of the hot top of an ingot mold, in which a hollow heat-insulating and retaining mold for hot tops 2 is placed on the upper end of the ingot mold 1, showing an example of an undesirable mold of conventional type in which the structure of the interior 3 of the mold 2 has the form of a lamination extending in substantially horizontal direction. Having such internal structure, the molding cannot resist the bath pressure when molten steel has been poured, and cracks may be produced, causing run-out, and it is inevitably necessary to make the molding 2 thicker than the thickness necessary for preventing such accidents.

Figure 2:
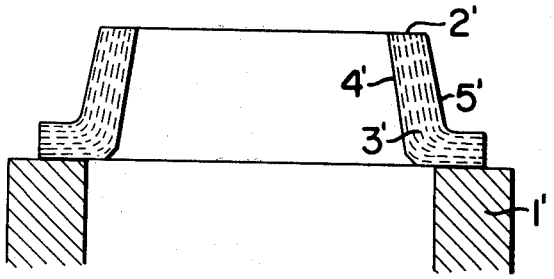
FIG. 2 is a longitudinal section of the top of an ingot mold on which is placed a heat-insulating and retaining molding for hot tops having the internal structure according to the present invention.

FIG. 2 is a longitudinal section showing the upper portion of an ingot mold 1' on the upper end of which the molding 2' of the present invention has been placed, the structure of the interior 3' of the molding 2' having been made as presenting the form of a lamination extending in the longitudinal direction along the inner surface 4' and the outer surface 5'. Since the molding, with such internal structure, can resist the bath pressure and the thermal stresses from the inside which are caused when the molten steel is poured, the disadvantages of the molding having the internal structure shown in FIG. 1 are eliminated, and accordingly an advantage that the thickness of the molding may be reduced to minimum thickness necessary for retaining the heat of the hot tops is obtained.

Figure 3:
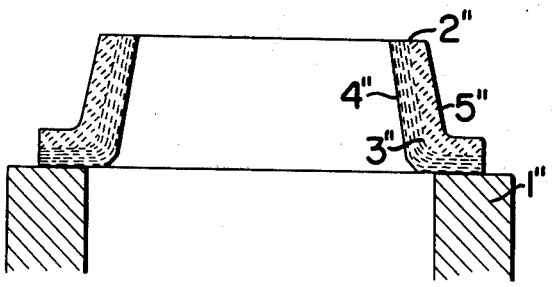
FIG. 3 is a longitudinal section of the top of an ingot mold on which is placed a heat-insulating and retaining molding for hot tops having other internal structure according to the present invention.

The molding shown in FIG. 3, representing a molding having another internal structure of the molding according to the present invention, in which only the internal portion 4" of the molding 2" placed on the upper end of the ingot mold 1" has been changed into a laminated structure extending in the longitudinal direction along the inside surface 4", and such molding resists the bath pressure and the thermal stresses, the abovementioned disadvantages being avoided thereby, and even if the molding does not have the external structure in the form of a lamination extending along the outer surface 5", the abovementioned object is attained satisfactorily and the disadvantages are eliminated.

The preferable composition range of the molding according to the present invention is as follows:

Organic fibrous material — less than 5% by weight
Inorganic fibrous material — 25- 35% by weight
Refractory material — 50 - 70% by weight (particle size, less than 1 mm.)
Organic binding material — 5 - 10% by weight As the organic fibrous material to be used in the molding according to the present invention, pulps and beated papers, and as such inorganic material, asbestos, slag wool, rock wool, glass wool may be used. As such refractory material, silica sand, quartz sand, magnesium oxide, aluminum oxide and silicate having particle size less than 1 mm. are used, and vermiculite, obsidian, perlite and shale which have been expanded by heating, or porous refractory materials such as diatomaceous earth and volcanic rock conglomerates may also be used.

Materials to be used as binding material in the molding according to the present invention, are synthetic resins such as phenol resin, furun resin, amino resin, resorcine resin, or mixed resin composed of more than two of these resins; and combined use of inorganic binging material such as water-glass is also possible. Use of a small quantity of borax is also preferable for preventing the production of dust at the time of elimination of residuals after use of the molding, thereby enhancing the separability of molding from the top of steel ingot, and preventing the occurrence of cracks due to the thermal stress of the molding in use.

An example of a method of manufacturing the heat-insulating and retaining molding for hot tops used at the time of steel ingot making according to the present invention, will now be described as follows. Water is added to an above-mentioned mixture so as to form a slurry of uniform composition which is filled into a molding pattern and molded by dehydration. In cases where the dehydration is effected from the bottom of molding pattern, an undesirable internal structure having substantially horizontal direction such as shown in FIG. 1 is formed. Contrary to this, a method of molding by dehydration from side or from side and extremity is used in the present invention, and a molding having desirable internal structure is obtained. The internal structure of the molding as shown in FIG. 2 is obtained by the dehydrating method effected from the inner 4' or outer side 5', and the internal structure of the molding as shown in FIG. 3 is obtained by the dehydrating method effected from inside an extremity of the molding pattern. Examples of the present invention will now be shown as follows.

TABLE 1

Compositions and shape (% by weight)

| Name of material | | | Example Numbers No. 1 | No. 2 | No. 3 | No. 4 | No. 5 |
|---|---|---|---|---|---|---|---|
| Beated paper (solid part) | | | 1 | 2 | 3 | 4 | 5 |
| Asbestos | | | — | — | 15 | 27 | 25 |
| Slag wool | | | 35 | 32 | 15 | — | — |
| Silicate sand (particle size: less than 1 mm. $SiO_2$: 93%) | | | 56 | 57 | 59 | 60 | 60 |
| Phenol resin (water soluble) | | | 7 | 8 | 5 | 9 | 10 |
| Water-glass | | | — | — | 3 | — | — |
| Borax($Na_2B_4O_7$, $10H_2O$ | | | 1 | 1 | — | — | — |
| Shape, etc. of the molding | Dimension (mm.) | Inside diameter | 630ϕ | 630ϕ | 580ϕ | 580ϕ | 580ϕ |
| | | Height | 300 | 300 | 220 | 220 | 220 |
| | | Thickness | 25 | 25 | 20 | 20 | 20 |
| | Internal structure | | Longtudinal layer in inside portion, transversal layer in outside portion | Longtudinal layer in the whole interior | Longtudinal layer in inside portion, transversal layer in outside portion | Longtudinal layer in the whole interior | Longtudinal layer in the whole interior |

(In the above Table, the internal structure of the molding having the form of a lamination extending in substantially horizontal direction is called transversal layer, and that having the form of a lamination extending in longitudinal direction along inside surface or outside surface is called longitudinal layer.)

Placing No. 1 and No. 2 moldings on a 5 ton ingot mold, and No. 3 to 5 moldings on a 3 ton ingot mold, ingot making operations have been effected.

Moldings having the same compositions and shapes as those of Nos. 1 to 5 shown in Table I but having horizontal laminations have been used in the same operations under the same conditions and the results thereof compared. Numerous cracks were produced in each molding. Run-outs occurred from the moldings in which larger cracks were produced. Casting operations thus became impossible. Elimination of residuals of molding from the peripheral surface of hot top after ingot making was remarkably difficult and sharp convex projections were produced due to the molten steel which penetrated into portions in which cracks that had been produced. On the contrary, where there were longitudinal laminations, no cracks were produced in the molding, the peripheral surface of the hot top after ingot making was smooth and, in particular, no dissipation of dust at the elimination stage of molding residuals was observed. The moldings maintained their original shape, and the removing operation of the molding residuals was easy.

In summary, the heat-insulating and retaining molds as shown in FIGS. 2 and 3 for hot tops have several advantages. They are resistant to the static pressure of the molten steel, and have a thin wall thickness while not lowering the heat retaining effect. The molds also have a frame made of cast iron which is simpler in construction than that of conventional frames.

Changes to the described embodiments may be made by one skilled in the art and such changes are included within the scope of this invention.

What is claimed is:

1. A heat-insulating and retaining molding for hot tops of a hollow cylindrical monoblock type with the continuous wall of said hollow cylinder having a generally L-shaped cross section and being formed of a composition comprising, by weight, 25 to 35 percent inorganic fibrous material, 1 to 5 percent organic fibrous material, 50 to 70 percent refractory material and 5 to 10 percent binder, with the fibrous material at the inner surface of said hollow cylinder being aligned essentially parallel to said surface.

2. The heat-insulating and retaining molding of claim 1 wherein the fibrous material at the outer surface of said hollow cylinder is aligned parallel to said outer surface.

3. The heat-insulating structure of claim 1 wherein the fibrous material at the outer surface of said hollow cylinder is aligned perpendicualr to said surface.

4. The heat-insulating structure of claim 1 wherein;

the inorganic fibrous material is selected from the group consisting of pulps, beated papers and mixtures thereof;

the inorganic material is selected from the group consisting of asbestos, slag wool, rock wool, glass wool and mixtures thereof;

the refractory material is selected from the group consisting of silica sand, quartz sand, magnesium oxide, aluminum oxide, silicate, vermiculite, obsidian, perlite, shale, diatomaceous earth, volcanic rock conglomerates and mixtures thereof; and the binding material is selected from the group consisting of phenol resin, furun resin, amino resin, resorcine resin and mixtures thereof.

* * * * *